United States Patent [19]

Ochi et al.

[11] 4,232,247

[45] Nov. 4, 1980

[54] PROJECTION TUBE WITH X-RAY SHIELDING MEANS ON TARGET

[75] Inventors: Matsuo Ochi, Neyagawa; Keisuke Miyoshi, Katano, both of Japan

[73] Assignee: Matsushita Electric Industrial Co., Ltd., Osaka, Japan

[21] Appl. No.: 968,408

[22] Filed: Dec. 11, 1978

[30] Foreign Application Priority Data

Dec. 12, 1977 [JP] Japan ..... 52-167312[U]

[51] Int. Cl.[3] ..... H01J 29/06; H01J 29/28

[52] U.S. Cl. ..... 313/474; 313/479

[58] Field of Search ..... 313/478, 479, 474

[56] References Cited

U.S. PATENT DOCUMENTS

| | | | |
|---|---|---|---|
| 2,291,406 | 7/1942 | Paehr | 313/479 |
| 2,453,003 | 11/1948 | Edwards | 313/478 X |
| 2,960,615 | 11/1960 | Harries | 313/474 |
| 3,543,073 | 11/1970 | Sheldon | 313/474 X |
| 3,610,994 | 10/1971 | Sheldon | 313/478 X |

*Primary Examiner*—Palmer C. Demeo

*Attorney, Agent, or Firm*—Stevens, Davis, Miller & Mosher

[57] ABSTRACT

A projection tube projects in front a visible light image produced by irradiating a target having a fluorescent screen formed on one surface thereof with an electron beam emitted from an electron gun. The projection tube includes an X-ray shield disposed to cover the surface of the target excluding the fluorescent screen, whereby the X-ray generated by irradiating the fluorescent screen on the target with the electron beam are shielded to prevent the transmission of the X-rays to the front of the projection tube, and also the X-ray shield has the effect of dissipating the heat from the target and simplifying the target positioning operation in the manufacture of projection tubes.

3 Claims, 14 Drawing Figures

PROJECTION TUBE WITH X-RAY SHIELDING MEANS ON TARGET

BACKGROUND OF THE INVENTION

1. Field of the Invention

The present invention relates to projection tubes of the type including a target having a fluorescent screen adapted to be irradiated with an electron beam and means for projecting in front the image produced on the fluorescent screen, and more particularly the invention relates to an improved projection tube including an X-ray shield disposed to cover the surfaces of the target excluding the fluorescent screen.

2. Description of the Prior Art

A known type of projection tube will now be described with reference to FIGS. 1, 2, 3, 4 and 5.

Generally, with the projection tube, as shown in FIG. 1, an electron beam 14 modulated by a picture signal and emitted from an electron beam 2 is focussed, deflected and then projected onto a fluorescent screen 3 on a target 4 which is carried on a supporting ring 6 by supporting means. The light emitted from the fluorescent screen 3 is reflected forward by a concave mirror 5 fixed to the other end of the supporting ring 6, and the reflected light reproduces an image on a screen in front through a faceplate 7 and a correction lens 8.

The target 4 and its supporting structure are shown in FIGS. 2A and 2B. Four supporting arms 10 each has its one end welded to a supporting plate 9 and its other end fixed by welding to the inner surface of the supporting ring 6. After the fixing by welding, the target 4 is fixed to the supporting plate 9 by screws 11 thus completing the assembly. Since the target 4 must be formed with the fluorescent screen 3 on one surface and since the target 4 itself tends to increase in temperature, the target 4 is made of aluminum material having excellent heat dissipating properties and ensuring easy formation of a fluorescent screen. When the target 4 made of such material is irradiated with the electron beam 14, X-rays are produced whose intensity is strong enough to pass through the thickness of the target 4. When the electron beam 14 is struck to the positions of points A and B on the target 4 as shown in FIG. 3, the resulting X-rays are transmitted through the interior of the target 4 and the X-rays are thus radiated to the front of the projection tube as shown by dotted lines 17 through its surface where the supporting plate 9 made of iron or the like is not present. The amount of the X-rays transmitted to the front was measured at position C, D and E in FIG. 4 with an X-ray measuring instrument (Victreen 440 RF/C) having an X-ray detecting means of 5 $cm^2$ and the results shown in FIG. 5 were obtained. It should be noted that some of the measurements were in excess of the value set by the HEW or 0.5 mR/h.

To overcome this problem of the X-ray transmission to the front of the projection tube, methods heretofore proposed are to use for the faceplate 7 and the correction lens 8 a glass material containing a large amount of lead or to increase the distance of the correction lens 8 from the faceplate 7 to such an extent which is sufficient to cause attenuation of X-rays. However, these proposed methods, particularly the latter is disadvantageous structurally in that the correction lens 8 must be made integral with the projection tube proper by molding or the like and consequently this has the effect of increasing the size of the apparatus using the tube and also making the positioning of the correction lens 8 impossible.

SUMMARY OF THE INVENTION

It is the object of the present invention to provide a projection tube with an improved structure which reduces the amount of X-rays radiated to the front of the tube and ensures an improved target assemblying accuracy without any increase in the external shape of the tube.

In accordance with the invention there is thus provided a projection tube comprising means for producing an electron beam, means for focussing and deflecting the electron beam, a target formed with a fluorescent screen disposed to be irradiated with the electron beam, and a concave mirror disposed to project forward the light emitted from the fluorescent screen, whereby at least the entire back surface of the target, preferably the entire peripheral surfaces of the target excluding the fluorescent screen are covered by X-ray shielding means made of a metal having a high X-ray absorption coefficient.

DESCRIPTION OF THE PREFERRED EMBODIMENTS

The present invention comprises a projection tube featuring an X-ray shield which provides shielding against leakage to the front of the tube of the X-rays emitted by the bombardment of the electron beam against the fluorescent screen of the target, and it has the advantages of an improved shielding against X-ray penetration, improved dissipation of the heat from the target and improved assembling accuracy in the manufacture of the target.

Figure 6:
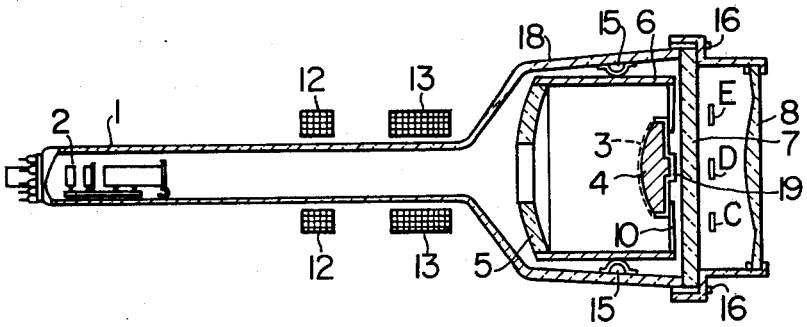
FIG. 6 is a sectional view of a projection tube according to an embodiment of the invention.

Referring now to FIG. 6, a projection tube has a neck 1 housing an electron gun 2 for producing an electron beam, and a funnel section 18 houses an assembly comprising a target 4 formed with a fluorescent screen 3 disposed opposite to the electron gun 2, a concave mirror 5 for projecting forward the light emitted from the fluorescent screen 3 and a supporting ring 6 in which the target 4 and the concave mirror 5 are mounted to oppose each other. The registration of the supporting ring 6 and the funnel section 18 is accomplished by means of fitting members 15. The front end of the funnel section 18 is sealed with a faceplate 7, and a correction lens 8 is mounted by screws 16 in a position which is in front and at a predetermined distance from the faceplate 7. The target 4 is provided with an X-ray shield 19 of a structure which does not disturb the light path of the reflected light from the concave mirror 5, and the X-ray shield 19 is fixed to one end of supporting arms 10 whose remaining ends are welded to the inner surface of the supporting ring 6 thus holding the target 4 in a predetermined position.

Figure 7A:
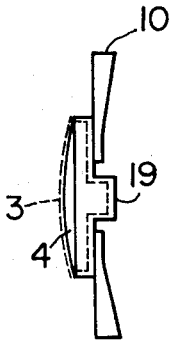
FIGS. 7A and 7B are respectively a side view and front view of the target and its supporting structure in the projection tube shown in FIG. 6.
Figure 7B:
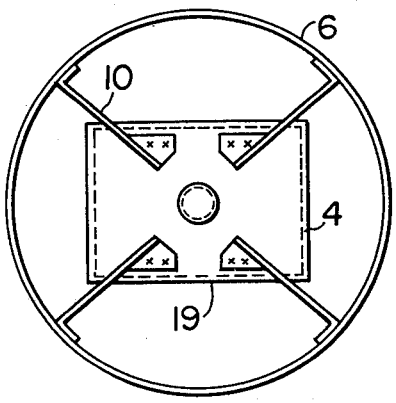

FIG. 7 shows the target 4, the X-ray shield 19 and their supporting structure. The X-ray shield 19 covers all the surfaces of the target 4 except the fluorescent screen 3, and the X-ray shield 19 is formed into a shape large enough to closely fit over the sides and back surface of the target 4, thus allowing the target 4 to be fixed in place fully firmly by pressing it into the shield 19 by suitable fitting means. The four supporting arms 10 each has its one end welded to the X-ray shield 19 and its other end welded to the inner surface of the supporting ring 6.

Figure 8:
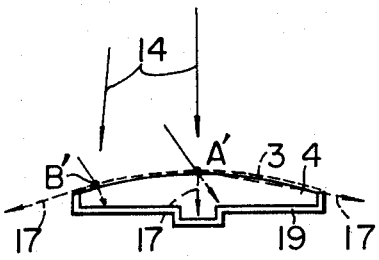
FIG. 8 is a side view of the target used in the embodiment of FIG. 6.

The X-ray shielding effect will now be described with reference to FIG. 8 showing the target 4. When a point A' on the target 4 is irradiated with an electron beam 14, X-rays are produced as shown by dotted lines 17 and in this case, due to the fact that the X-ray shield 19 is closely fitted to cover the surfaces of the target 4 excluding the fluorescent screen 3, the X-rays and particularly the X-rays directed to the front are practically completely absorbed by the X-ray shield 19. When a point B' on the target 4 is irradiated by the electron beam 14, the resulting X-rays are absorbed by a part of the X-ray shield 19 covering the side of the target 4. On the other hand, the X-rays emitted in the directions along the surface of the fluorescent screen 3 are absorbed by the supporting ring 6 as shown in FIG. 6, and by virtue of these actions the X-rays are practically completely prevented from passing to the front of the tube. A part of the X-ray shield 19 covering the peripheral surface of the target 14 is provided at a portion of the target 4 spaced apart from the fluorescent screen 3 and hence the light emitted from the fluorescent screen 3 to which the electron beam 14 is applied from the cathode 2 is effectively reflected through the concave mirror 5 without the disturbance of the X-ray shield 19.

Figure 9:
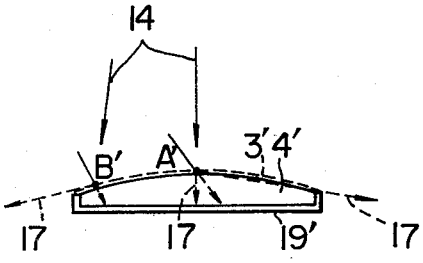
FIG. 9 is a side view of a target according to another embodiment of the projection tube of the present invention.

FIG. 9 shows a target 4' and an X-ray shield 19' used in another embodiment of the invention, and while the target 4' differs in shape from the counterpart in the embodiment of FIG. 6, it is possible to easily adapt the shape of the X-ray shield 19' to the shape of the target 4' within the scope of the invention.

Figure 1:
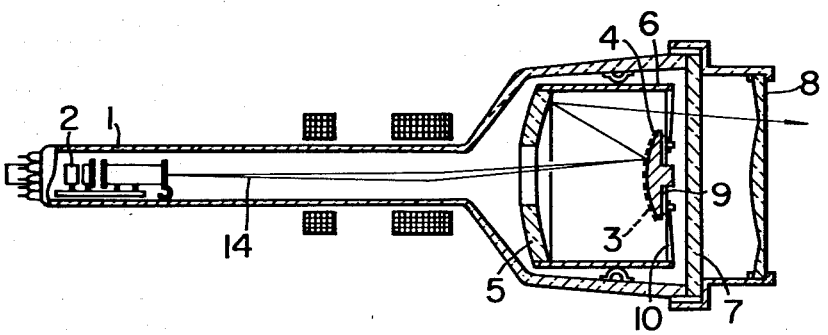
FIG. 1 PRIOR ART
FIG. 1 is a sectional view of a prior art projection tube.
Figure 2A:
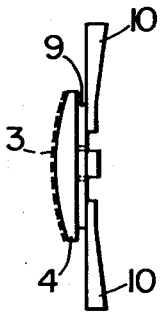
PRIOR ART FIG. 2A
FIG. 2 shows the details of the prior art projection tube, with FIG. 2A showing a side view of the target and its supporting members and FIG. 2B showing a front view of the target and its supporting members.
Figure 2B:
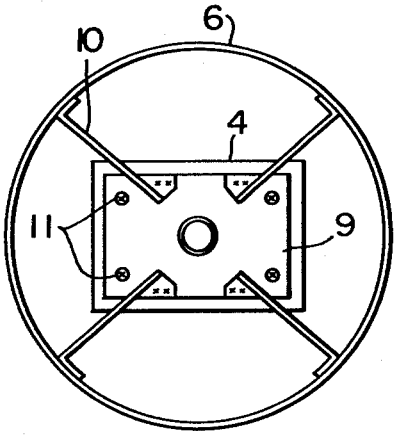
PRIOR ART FIG. 2B
Figure 3:
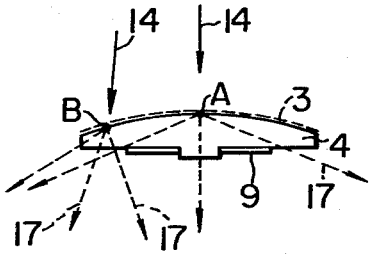
PRIOR ART FIG. 3
FIG. 3 is a side view of the target of the prior art projection tube.
Figure 4:
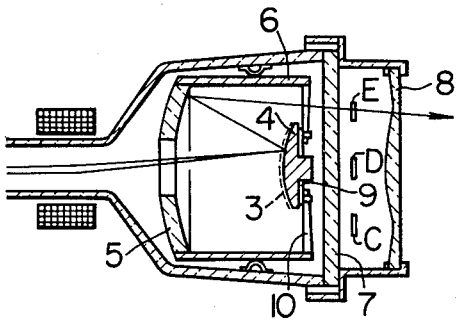
FIG. 4 PRIOR ART
FIG. 4 is a sectional view of the principal parts of the prior art projection tube, showing X-radiation measuring points C, D and E.
Figure 5:
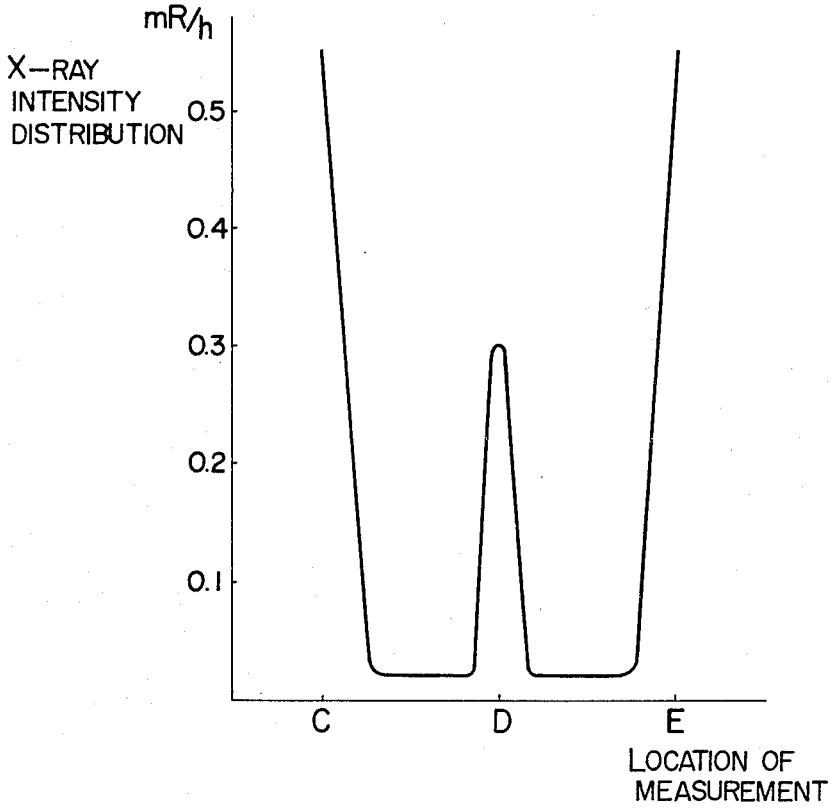
FIG. 5 is a diagram showing an X-ray intensity distribution in the front of the prior art projection tube.
Figure 10:
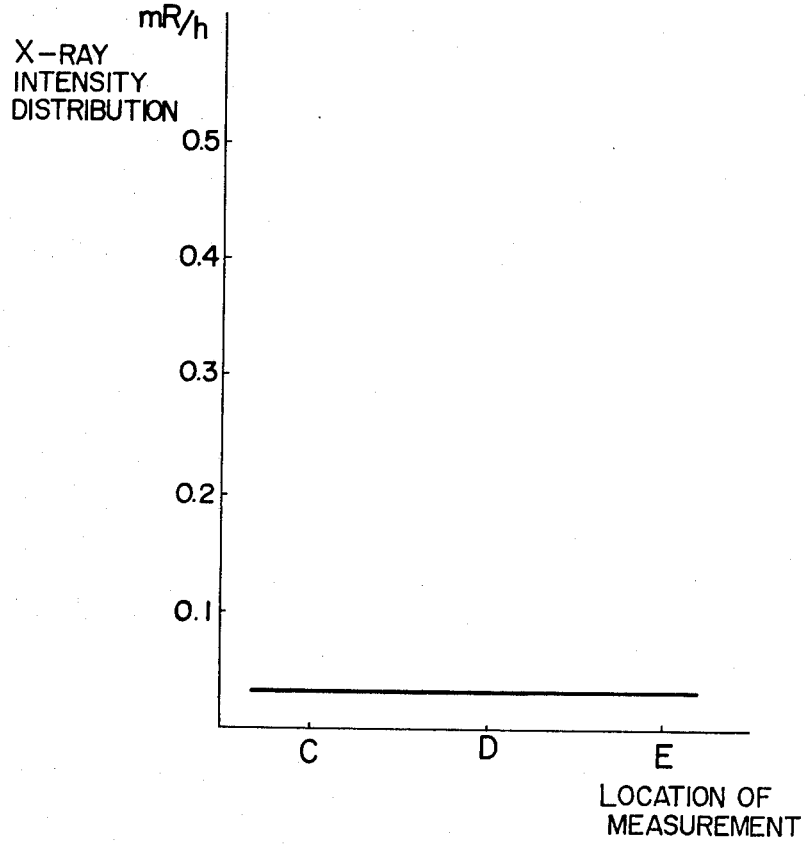
FIG. 10 is a diagram showing an X-ray intensity distribution measured at points in front of the tube of this invention in FIG. 6.

FIG. 10 is a graph showing the results of measurements made using an X-ray measuring instrument (Victreen 440 RF/C) having a detector of 5 $cm^2$ and removing the screwed correction lens 8 from the projection tube of FIG. 6 and at certain points in the front of the tube according to the HEW specifications. A comparison with the measured values of the prior art projection tube of FIG. 5 will prove an excellent X-ray shielding effect of the present invention, that is, the tube of the invention is quite excellent from the safety point of view.

Figure 11A:
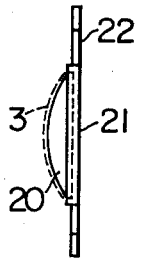
FIGS. 11A and 11B are a side view and front view of still another embodiment of the invention, showing its target and target supporting means.
Figure 11B:
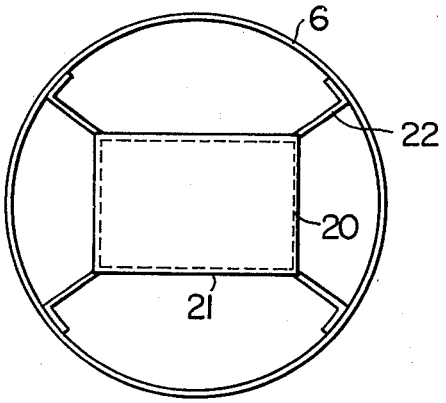

FIG. 11 shows a target 20 and an X-ray shield 21 according to still another embodiment of the invention. A great feature of the X-ray shield 21 is that the shield 21 and its supporting arms 22 are integrally stamped out from a single sheet metal or formed by using a mold, for example. It is needless to say that the inner surface of the X-ray shield 21 has the same shape as the target 20 and it also includes folded portions which extend to the sides of the target 20. The X-ray shield 21 has the same excellent X-ray shielding effect as the counterparts of the previously mentioned embodiments of the invention, and it also has the advantage of ensuring an accurate and efficient asembling operation due to the fact that it is only necessary to weld the ends of the supporting arms 22 to the inner surface of the supporting ring 6.

The above described embodiments of the invention each has another great advantage of a greater target heat dissipating effect due to an increased contact area between the target and the X-ray sheild. Further, by virtue of the fact that as compared with the prior art projection tube, there is no need to unnecessarily increase the distance between the faceplate and the correction lens and there is no need to use any fixing means such as molds, the present invention is useful in the manufacture of small-size projection tubes.

We claim:

1. A projection tube comprising: means for producing an electron beam; means for focussing and deflecting said electron beam; a target having a fluorescent screen disposed to be irradiated with said electron beam; X-ray shielding means disposed to cover an entire back surface and entire peripheral surfaces of said target without obstructing said fluorescent screen; a concave mirror disposed to project forward light emitted from said fluorescent screen; and means disposed to correct the light projected by said concave mirror.

2. A projection tube according to claim 1, wherein said X-ray shielding means is a part of target supporting means disposed to hold said target in a predetermined spatial position inside said tube.

3. A projection tube including means for producing an electron beam, means disposed to focus and deflect said electron beam, a target having a fluorescent screen disposed to be irradiated with said electron beam, a concave mirror disposed to project forward light emitted from said fluorescent screen, a supporting ring fastened at one end thereof to said concave mirror and having fastened to the other end thereof a plurality of supporting arms holding said target in a predetermined spatial position; and means disposed in a path for correcting the light emitted from said concave mirror; said projection tube further comprising X-ray shielding means made integral with said supporting arms and which cover a back surface and said surfaces of said target, said supporting ring being made of an X-ray absorbing material, said supporting arms integral with said X-ray shielding means having one end thereof fastened to said supporting ring.

* * * * *